US008513598B2

(12) United States Patent
Fergenson et al.

(10) Patent No.: US 8,513,598 B2
(45) Date of Patent: Aug. 20, 2013

(54) AEROSOL MASS SPECTROMETRY SYSTEMS AND METHODS

(75) Inventors: David P. Fergenson, Alamo, CA (US); Eric E. Gard, San Francisco, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 1092 days.

(21) Appl. No.: 12/338,623

(22) Filed: Dec. 18, 2008

(65) Prior Publication Data

US 2009/0250606 A1 Oct. 8, 2009

Related U.S. Application Data

(60) Provisional application No. 61/016,190, filed on Dec. 21, 2007.

(51) Int. Cl.
*H01J 49/40* (2006.01)

(52) U.S. Cl.
CPC ..... *H01J 49/40* (2013.01)
USPC ..... 250/287

(58) Field of Classification Search
USPC ..... 250/288, 287, 281, 282; 436/173, 436/183
See application file for complete search history.

(56) References Cited

U.S. PATENT DOCUMENTS

| | | | | |
|---|---|---|---|---|
| 5,681,752 | A | 10/1997 | Prather | 436/173 |
| 5,998,215 | A | 12/1999 | Prather et al. | 436/173 |
| 6,806,464 | B2 | 10/2004 | Stowers et al. | 250/286 |
| 6,847,035 | B2 | 1/2005 | Sharma | 250/287 |
| 7,170,052 | B2 * | 1/2007 | Furutani et al. | 250/287 |
| 7,260,483 | B2 * | 8/2007 | Gard et al. | 702/22 |
| 2004/0024539 | A1 | 2/2004 | Gard et al. | 702/28 |
| 2005/0073683 | A1 | 4/2005 | Gard et al. | 356/337 |
| 2007/0057177 | A1 * | 3/2007 | Kim et al. | 250/287 |

OTHER PUBLICATIONS

Prather K. A. et al: "Real-Time Characterization of Individual Aerosol Particles Using Time-of-Flight Mass Spectrometry". Analytical Chemistry, American Chemical Society. Columbus, US, vol. 66, No. 9, May 1, 1994, pp. 1403-1407, XP000446026. ISSN: 0003-2700. p. 1403, right-hand column—p. 1404, left-hand column, figures 1, 2.
Murphy D. M. et al: "Laser Ionization Mass Spectroscopy of Single Aerosol Particles". Aerosol Science and Technology, Elsevier Science Publishing, New York, NY, US, vol. 22, Jan. 1, 1995, pp. 237-249, XP002915682. ISSN: 0278-6826. p. 238, right-hand column, paragraph 1. p. 240, right-hand column, last paragraph.
Salt et al., "Aerodynamic Particle Sizing versus Light Scattering Intensity Measurement as Methods for Real-Time Particle Sizing Coupled with Time-of-Flight Mass Spectrometry" Analytical Chemistry, vol. 68, No. 1, Jan. 1, 1996.

(Continued)

*Primary Examiner* — Kiet T Nguyen
(74) *Attorney, Agent, or Firm* — Dominic M. Kotab

(57) ABSTRACT

A system according to one embodiment includes a particle accelerator that directs a succession of polydisperse aerosol particles along a predetermined particle path; multiple tracking lasers for generating beams of light across the particle path; an optical detector positioned adjacent the particle path for detecting impingement of the beams of light on individual particles; a desorption laser for generating a beam of desorbing light across the particle path about coaxial with a beam of light produced by one of the tracking lasers; and a controller, responsive to detection of a signal produced by the optical detector, that controls the desorption laser to generate the beam of desorbing light. Additional systems and methods are also disclosed.

31 Claims, 2 Drawing Sheets

(56) References Cited

OTHER PUBLICATIONS

Prather et al., Real-Time Characterization of Individual Aerosol Particles Using Time-of-Flight Mass Spectrometry Analytical Chemistry, vol. 66, No. 9, May 1, 1994.

Gard et al., "Real-Time Analysis of Individual Atmospheric Aerosol Particles: Design and Performance of a Portable ATOFMS" Analytical Chemistry, vol. 69, No. 20, Oct. 15, 1997.

"On-Line Single-Particle Analysis by Laser Desorption Mass Spectrometry" Analytical Chemistry. 1991, 63, 2069-2073.

Fergenson et al., "Reagentless Detection and Classification of Individual Bioacrosol Particles in Seconds" Analytical Chemistry , Oct. 9, 2003.

U.S. Appl. No. 10/916,737, filed Aug. 11, 2004.

U.S. Appl. No. 10/280,608, filed Apr. 22, 2002.

* cited by examiner

AEROSOL MASS SPECTROMETRY SYSTEMS AND METHODS

RELATED APPLICATIONS

This application claims priority to provisional U.S. application Ser. No. 61/016,190 filed on Dec. 21, 2007, which is herein incorporated by reference.

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to aerosol mass spectrometry, and more particularly to systems and methods for more efficient mass spectrometry.

BACKGROUND

As noted in provisional U.S. application Ser. No. 61/016,190 filed on Dec. 21, 2007, which has been incorporated by reference, a class of analytical instruments known as single particle mass spectrometers has been used to characterize particles. Single particle mass spectrometers in general are instruments that sample individual small particles from the air, typically determine their size in some way, desorb and ionize them using one or more lasers, and collect mass spectra of the resulting ions. One type of single particle mass spectrometer is the Aerosol Time-of-Flight Mass Spectrometry (ATOFMS). Another type of single particle mass spectrometer is the Rapid Single Particle Mass Spectrometer (RSPMS). However, each type of known single particle mass spectrometers has drawbacks.

Therefore, it would be desirable to overcome such disadvantages, allowing characterization of particles with high accuracy and minimal cost.

SUMMARY

A system according to one embodiment includes a particle accelerator that directs a succession of polydisperse aerosol particles along a predetermined particle path; multiple tracking lasers for generating beams of light across the particle path; an optical detector positioned adjacent the particle path for detecting impingement of the beams of light on individual particles; a desorption laser for generating a beam of desorbing light across the particle path about coaxial with a beam of light produced by one of the tracking lasers; and a controller, responsive to detection of a signal produced by the optical detector, that controls the desorption laser to generate the beam of desorbing light.

A system according to another embodiment includes a particle accelerator that directs a succession of polydisperse aerosol particles along a predetermined particle path; a desorption laser for generating a beam of desorbing light across the particle path; a light source for generating a beam of light about coaxial with the desorbing light beam; one or more light sources for generating beams of light upstream of the desorbing light beam; an optical detector positioned adjacent the particle path for detecting impingement of the beams of light on individual particles; a controller, responsive to detection of signals produced by the optical detector, that controls the desorption laser to selectively generate the beam of desorbing light and that determines velocities of the particles based on the signals; and a mass spectrometer that outputs an indication of a chemical composition of component molecules associated with each desorbed particle.

A method according to one embodiment includes directing a succession of individual polydisperse aerosol particles along a predetermined particle path; determining aerodynamic sizes of the particles traveling along the particle path; determining that individual particles have arrived at about a location for analysis; directing a collimated beam of light across the particle path to desorb the particles into component molecules thereof and to ionize at least some of the molecules; and determining a chemical composition of the ionized molecules associated with each desorbed particle.

A method according to another embodiment includes directing a succession of individual polydisperse aerosol particles along a predetermined particle path; determining when the individual particles have arrived at about a location for analysis by detecting impingement of a light beam on the particles; directing a beam of desorbing light across the particle path and about coaxial with the light beam to desorb the particles into component molecules thereof and to ionize at least some of the molecules; determining a chemical composition of the ionized molecules associated with each desorbed particle; and determining velocities of the particles traveling along the particle path by detecting light scattered from the particles due to impingement of multiple beams of light on the particles traveling along the particle path, and measuring a time delay between detection of the scattered light, such time delay indicating a velocity of the associated particle.

Other aspects and embodiments of the present invention will become apparent from the following detailed description, which, when taken in conjunction with the drawings, illustrate by way of example the principles of the invention.

DETAILED DESCRIPTION

Figure 1:
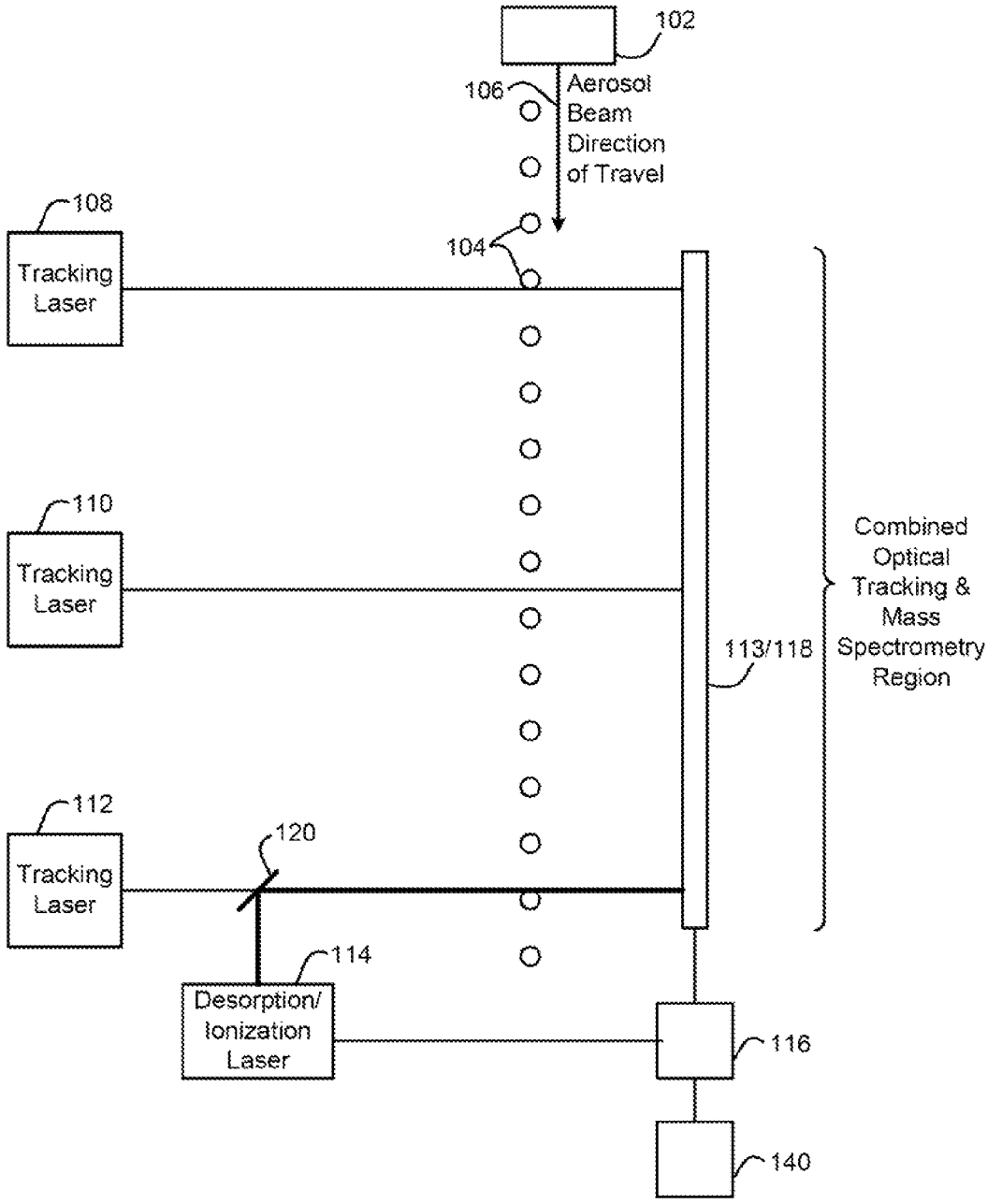
FIG. 1 is a schematic diagram of an aerosol mass spectrometry system according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

Some embodiments of the present invention include a new design for aerosol particle tracking systems used in mass spectrometry that results in an instrument that is approximately five times as efficient as previous designs were under the best circumstances. This improved efficiency provides shorter times-to-detection and a greater tolerance of background particle populations for a fixed concentration of a certain type of aerosol particle present in the air, and/or to greater sensitivity at low concentrations of said type of particle. Some embodiments of the present invention allow a far greater number of particles to be analyzed by mass spectrometry per unit time compared to prior systems, while still allowing the precise determination of particle size.

In one general embodiment, a system comprises a particle accelerator that directs a succession of polydisperse aerosol particles along a predetermined particle path; multiple tracking lasers for generating beams of light across the particle path; an optical detector positioned adjacent the particle path for detecting impingement of the beams of light on individual particles; a desorption laser for generating a beam of desorbing light across the particle path about coaxial with a beam of light produced by one of the tracking lasers; and a controller, responsive to detection of a signal produced by the optical detector, that controls the desorption laser to generate the beam of desorbing light.

In another general embodiment, a system comprises a particle accelerator that directs a succession of polydisperse aerosol particles along a predetermined particle path; a desorption laser for generating a beam of desorbing light across the particle path; a light source for generating a beam of light about coaxial with the desorbing light beam; one or more light sources for generating beams of light upstream of the desorbing light beam; an optical detector positioned adjacent the particle path for detecting impingement of the beams of light on individual particles; a controller, responsive to detection of signals produced by the optical detector, that controls the desorption laser to selectively generate the beam of desorbing light and that determines velocities of the particles based on the signals; and a mass spectrometer that outputs an indication of a chemical composition of component molecules associated with each desorbed particle.

In one general embodiment, a method comprises directing a succession of individual polydisperse aerosol particles along a predetermined particle path; determining aerodynamic sizes of the particles traveling along the particle path; determining that individual particles have arrived at about a location for analysis; directing a collimated beam of light across the particle path to desorb the particles into component molecules thereof and to ionize at least some of the molecules; and determining a chemical composition of the ionized molecules associated with each desorbed particle.

In another general embodiment, a method comprises directing a succession of individual polydisperse aerosol particles along a predetermined particle path; determining when the individual particles have arrived at about a location for analysis by detecting impingement of a light beam on the particles; directing a beam of desorbing light across the particle path and about coaxial with the light beam to desorb the particles into component molecules thereof and to ionize at least some of the molecules; determining a chemical composition of the ionized molecules associated with each desorbed particle; and determining velocities of the particles traveling along the particle path by detecting light scattered from the particles due to impingement of multiple beams of light on the particles traveling along the particle path, and measuring a time delay between detection of the scattered light, such time delay indicating a velocity of the associated particle.

FIG. 1 illustrates an aerosol mass spectrometry system 100 having a particle accelerator 102 that directs a succession of polydisperse aerosol particles 104 along a predetermined particle path in the direction shown by arrow 106. Illustrative particle accelerators for use with particles in air include orifices, converging nozzles, aerodynamic focusing lens stacks, etc. Basically any small orifice across which a pressure differential can be created will work to some extent.

Figure 2:
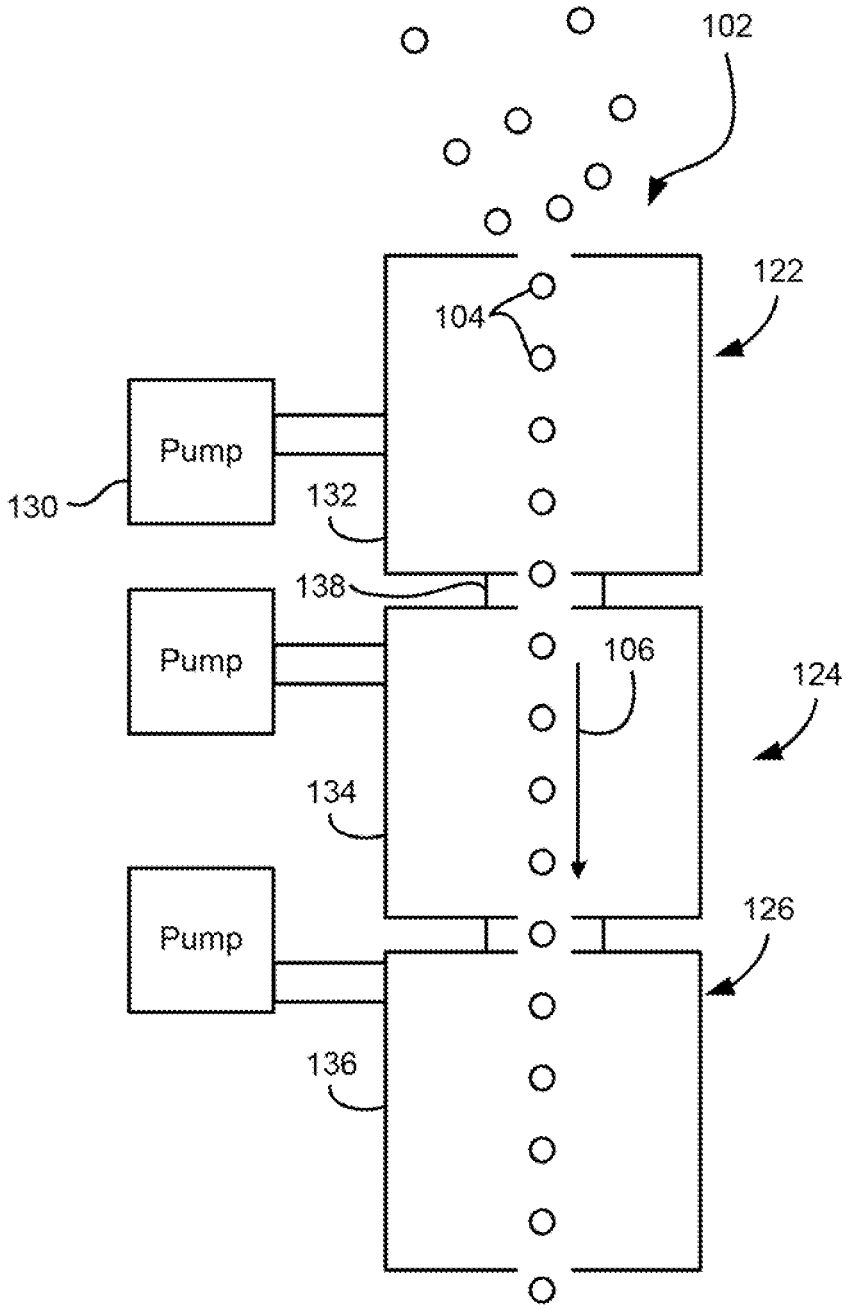
FIG. 2 is a schematic diagram of a particle accelerator according to one embodiment.

In one particularly preferred embodiment, as shown in FIG. 2. the particle accelerator 102 includes a multiple-stage vacuum system, each stage 122, 124, 126 of the vacuum system including a vacuum pump 130 and each stage directing individual particles along the particle path. For example, the multiple-stage vacuum system may include a plurality of concentric tubes 132, 134, 136 supporting a vacuum of progressively increasing amount; and wherein the plurality of concentric tubes are separated from each other by skimmers 138 aligned along the particle path.

Illustrative particles are in a range of between about 50 nm-10 micrometers in diameter, though could be larger or smaller.

Referring again to FIG. 1, a set of tracking lasers 108, 110, 112, three in the illustration but the number could be more or less, operate to generate beams of light across the particle path in a combined tracking and mass spectrometry region. The tracking lasers may be aligned with the desired beam path, or some type of guiding device may be used, such as one or more mirrors. The tracking lasers may be continuous wave lasers that generate light continuously during the testing period.

An optical detector 113 is positioned adjacent the particle path for detecting impingement of the beams of light on individual particles. The light detector may include one or more discrete light detectors, and may be a single component or multiple discrete components.

The velocity of each particle is generally determined by measuring a time delay between detections of scattered light by the optical detector, e.g., the time it takes for a particle to pass between two laser beams separated by a known distance. As individual particles cross the laser beams, the times of their crossings, or an elapsed time between crossings, as detected by the optical detector 113 may be stored for later use, and/or used immediately to determine the velocity of the particle. A timing device 140 may be employed to provide a timing reference. Because of noise and finite clock speed, velocity is determined most accurately when the spacing (and hence transit time) between laser beams is large.

In one approach, two lasers that are spaced a known distance apart are pointed to intersect the particle beam. As a particle passes through the first laser beam, e.g., from laser 108, a counter is started which is stopped as a particle crosses the second laser beam, e.g., from laser 110 or 112. In another approach, the spacings between the first and second laser and the second and third laser are made identical. The times at which a particle is determined to have crossed each of the first two lasers is noted. Upon the detection of a particle at the third laser, the times are analyzed to determine if equal delays between particle detections between each pair of lasers exist, indicating that those detections were all of the same particle. The delay between detections is used to determine that particle's velocity.

Using more than two lasers to perform the particle tracking resolves ambiguities derived from two different particles actuating the timing circuit as each crosses one laser individually. Accordingly, multiple tracking events can be used to ensure that three or more particle detections occurred at the proper time spacings. At higher concentrations of particles, more lasers may be used but three has been found to be practical at most reasonable concentrations.

The beam from the lowest tracking laser 112 is about coaxial with a path of a beam from a desorption/ionization laser 114 near or at the location for analysis, thereby forming a collimated beam when both lasers are active in some embodiments. Any suitable mechanism for creating the collimated beam may be used, such as a dichroic mirror 120, etc.

Because the beam from the last tracking laser 112 is about coaxial with a path of a beam from a desorption/ionization laser 114, the beam from the desorption/ionization laser will not miss the particles if actuated when a particle impinges the beam from the last tracking laser. This means that every time a particle is detected, it will be hit by the desorption/ionization laser. Moreover, the problems associated with attempting to temporally fire the desorption/ionization laser based on a velocity of the particle are avoided.

The desorption/ionization laser may be of any type capable of generating light that causes desorbing the particles into component molecules thereof and ionizing at least some of the molecules. The desorption/ionization laser is typically much higher power than the first two lasers and does not operate continuously. Instead, it is ordered to fire a high energy pulse of light at the moment that the particle crosses its path, as detected by the optical detector detecting impingement of the tracking laser 112 on the particle. Because of this accuracy, the laser energy that the desorption/ionization laser produce may be focused into a smaller area, thereby requiring less power.

Preferably, the desorption/ionization laser does not require a long period between being told to fire and actually producing light. For example, a Nd:YAG laser may be used. The YAG laser is pumped by diodes, and, as such, does not require the delay between the initial order to fire and the emission of light. These lasers can also fire at much higher rates of repetition than the flash lamp pumped lasers.

The desorption/ionization laser may be aimed at the center of the source region of a mass spectrometer, so when it fires upon the particle, it desorbs material from the particle and ionizes the material, allowing the ions to be analyzed by mass spectrometry.

A mass spectrometer 118 analyzes mass spectra data of the ionized component molecules associated with each desorbed particle and outputs an indication of a chemical composition of each of the molecules. Any type of mass spectrometer may be used. In particularly preferred approaches, the mass spectrometer is a time-of-flight mass spectrometer.

A controller 116 may also be present to perform some or all of the computations described herein, to control any of the hardware described herein, etc. In one approach, the controller controls the desorption laser to generate the beam of desorbing light in response to detection of a signal produced by the optical detector. For example, upon the detection of a particle crossing the last tracking laser 112, the desorption/ionization laser is instructed to fire about immediately. Because its beam is in about the same location as the final tracking laser beam, it will not miss its target.

The combination of the aerodynamic size with the mass spectrometry data provides a very accurate indicator of the composition of the particles. The aerodynamic size of the particles may be determined and used to characterize the particles. The aerodynamic diameter (used interchangeably with aerodynamic size) of a particle is equivalent to the physical diameter of a unit density sphere that displays identical aerodynamic behavior.

When a gas travels though a properly designed pressure gradient, entrained particles are focused and accelerated to a terminal velocity dependent upon their aerodynamic diameter. Measurement of the subsequent particle velocity is thus a means to obtain accurate aerodynamic particle size data.

Assuming that the particle accelerator has imparted the particle with a velocity characteristic of its aerodynamic diameter, the aerodynamic diameter may be determined from the velocity using a calibration curve empirically derived with standardized test particles. In one approach, the aerodynamic size of the particle is determined retrospectively by looking back at the previous tracking events associated with the tracking lasers. For example, the controller may retrospectively determine aerodynamic sizes of the particles analyzed by the mass spectrometer by polling the optical detector after the particles are analyzed by the mass spectrometer. This mode saves energy and computation time by only determining sizes of those particles that are ultimately analyzed by the mass spectrometer. In another approach, the aerodynamic size of the particle is determined upon the particle passing through the tracking laser beams, e.g., immediately, upon some predetermined delay, etc.

In one embodiment, the upper tracking lasers and/or the tracking laser that is coaxial with the desorption/ionization laser may also be incorporated in an additional or orthogonal method of particle detection such as fluorescence or shape analysis using known methodology and components. In the former case, one of the lasers may be an ultraviolet (UV) laser, and the optical detector may detect fluorescence emitted from the particle after being struck by the UV laser beam. Preferably, the results of these types of detection are evolved relatively quickly or even instantaneously.

It should also be understood that the techniques presented herein might be implemented using a variety of technologies. For example, the methods described herein may be implemented in software running on a computer system, or implemented in hardware utilizing either a combination of microprocessors or other specially designed application specific integrated circuits, programmable logic devices, or various combinations thereof. In particular, methods described herein may be implemented by a series of computer-executable instructions residing on a storage medium such as a carrier wave, disk drive, or computer-readable medium. Exemplary forms of carrier waves may be electrical, electromagnetic or optical signals conveying digital data streams along a local network or a publicly accessible network such as the Internet. In addition, although specific embodiments of the invention may employ object-oriented software programming concepts, the invention is not so limited and is easily adapted to employ other forms of directing the operation of a computer.

Various embodiments can also be provided in the form of a computer program product comprising a computer readable medium having computer code thereon. A computer readable medium can include any medium capable of storing computer code thereon for use by a computer, including optical media such as read only and writeable CD and DVD, magnetic memory, semiconductor memory (e.g., FLASH memory and other portable memory cards, etc.), etc. Further, such software can be downloadable or otherwise transferable from one computing device to another via network, wireless link, nonvolatile memory device, etc.

Additionally, some or all of the aforementioned code may be embodied on any computer readable storage media including tape, FLASH memory, system memory, hard drive, etc. Additionally, a data signal embodied in a carrier wave (e.g., in a network including the Internet) can be the computer readable storage medium.

Illustrative Uses of the Invention

Embodiments of the present invention may be implemented as part of a more efficient BioAerosol Mass Spectrometer for civilian biodefense. Embodiments may also be used to perform more efficient environmental analyses by research organizations. Embodiments may be used to control entry into the United States of individual carrying contagious respiratory illnesses. Embodiments may be used to detect and identify contraband noninvasively.

Further embodiments may be used for forensic purposes, for environmental analysis and remediation, for rapid medical diagnoses of respiratory ailments, in industrial process control, to identify the sources of environmental contamination affecting semiconductor manufacture, etc.

Those skilled in the art will appreciate that a plethora of other uses are possible.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A system, comprising:

a particle accelerator that directs a succession of polydisperse aerosol particles along a predetermined particle path;

multiple tracking lasers for generating beams of light across the particle path;

an optical detector positioned adjacent the particle path for detecting impingement of the beams of light on individual particles;

a desorption laser for generating a beam of desorbing light across the particle path about coaxial with a beam of light produced by one of the tracking lasers; and a controller, responsive to detection of a signal produced by the optical detector, that controls the desorption laser to generate the beam of desorbing light.

2. The system of claim 1, further comprising a mass spectrometer that outputs an indication of a chemical composition of component molecules associated with each desorbed particle.

3. The system of claim 2, wherein the mass spectrometer is a time-of-flight mass spectrometer.

4. The system of claim 2, wherein the controller retrospectively determines aerodynamic sizes of the particles analyzed by the mass spectrometer by polling the optical detector after the particles are analyzed by the mass spectrometer.

5. The system of claim 1, wherein the particle accelerator includes a multiple-stage vacuum system, each stage of the vacuum system including a vacuum pump and each stage directing individual particles along the particle path.

6. The system of claim 5, wherein the multiple-stage vacuum system includes a plurality of tubes supporting a vacuum of progressively increasing amount; and wherein the plurality of tubes are separated from each other by skimmers aligned along the particle path.

7. The system of claim 1, wherein the tracking lasers include a laser for generating the beam of light about coaxial with the desorbing light to allow determination of the presence of particles in the particle path and actuation of the desorption laser; and one or more lasers for generating beams of light upstream of the desorbing light beam to allow determination of the velocities of the particles in the moments before the desorption laser was actuated.

8. The system of claim 1, further comprising a timing device for measuring a time delay between detections of scattered light by the optical detector, such time delay indicating the velocity of one of the particles.

9. The system of claim 1, wherein the desorbing light beam desorbs each particle into its component molecules and ionizes at least some of the molecules.

10. The system of claim 1, wherein the desorption laser includes an Nd:YAG laser that produces pulses of light having sufficient energy to desorb the particles.

11. The system of claim 1, wherein the optical detector detects fluorescence emitted from the particle.

12. A system, comprising:

a particle accelerator that directs a succession of polydisperse aerosol particles along a predetermined particle path;

a desorption laser for generating a beam of desorbing light across the particle path;

a light source for generating a beam of light about coaxial with the desorbing light beam;

one or more light sources for generating beams of light upstream of the desorbing light beam;

an optical detector positioned adjacent the particle path for detecting impingement of the beams of light on individual particles;

a controller, responsive to detection of signals produced by the optical detector, that controls the desorption laser to selectively generate the beam of desorbing light and that determines velocities of the particles based on the signals; and a mass spectrometer that outputs an indication of a chemical composition of component molecules associated with each desorbed particle.

13. A method, comprising:

directing a succession of individual polydisperse aerosol particles along a predetermined particle path;

determining aerodynamic sizes of the particles traveling along the particle path;

determining that individual particles have arrived at about a location for analysis;

directing a collimated beam of light across the particle path to desorb the particles into component molecules thereof and to ionize at least some of the molecules;

generating beams of light upstream of the collimated beam of light and at least one beam of light about coaxial with the collimated beam of light; and determining a chemical composition of the ionized molecules associated with each desorbed particle.

14. The method of claim 13, wherein the aerodynamic sizes of the particles traveling along the particle path are determined retrospectively, after the determination that they have arrived at the location for analysis.

15. The method of claim 13, wherein determining aerodynamic sizes of the particles traveling along the particle path includes detecting light scattered from the particles due to impingement of multiple beams of light on the particles traveling along the particle path, and measuring a time delay between detections of the scattered light, such time delay indicating a velocity of the associated particle.

16. The method of claim 13, wherein the chemical composition is determined by a mass spectrometer that outputs an indication of a chemical composition of the component molecules associated with each desorbed particle.

17. The method of claim 16, wherein the mass spectrometer is a time-of-flight mass spectrometer.

18. The method of claim 13, wherein the particles are directed along the particle path using a particle accelerator that includes a multiple-stage vacuum system, each stage of the vacuum system including a vacuum pump and each stage directing individual particles along the particle path.

19. The method of claim 18, wherein the multiple-stage vacuum system includes a plurality of concentric tubes supporting a vacuum of progressively increasing amount; and wherein the plurality of concentric tubes are separated from each other by skimmers aligned along the particle path.

20. The method of claim 13, wherein the collimated beam includes light from an Nd:YAG laser that produces pulses of light having sufficient energy to desorb the particles.

21. The method of claim 13, wherein the aerodynamic sizes of the particles traveling along the particle path are determined prior to the determination that they have arrived at the location for analysis.

22. A method, comprising:

directing a succession of individual polydisperse aerosol particles along a predetermined particle path;

determining when the individual particles have arrived at about a location for analysis by detecting impingement of a light beam on the particles;

directing a beam of desorbing light across the particle path and about coaxial with the light beam to desorb the particles into component molecules thereof and to ionize at least some of the molecules;

determining a chemical composition of the ionized molecules associated with each desorbed particle; and determining velocities of the particles traveling along the particle path by detecting light scattered from the particles due to impingement of multiple beams of light on the particles traveling along the particle path, and measuring a time delay between detections of the scattered light, such time delay indicating a velocity of the associated particle.

23. The method of claim 22, wherein aerodynamic sizes of the particles traveling along the particle path are determined retrospectively, after the determination that they have arrived at the location for analysis.

24. The method of claim 22, wherein determining aerodynamic sizes of the particles traveling along the particle path includes detecting light scattered from the particle due to impingement of multiple beams of light on the particles traveling along the particle path, and measuring a time delay between detections of the scattered light, such time delay indicating a velocity of the associated particle.

25. The method of claim 22, wherein the chemical composition is determined by a mass spectrometer that outputs an indication of a chemical composition of the component molecules associated with each desorbed particle.

26. The method of claim 25, wherein the mass spectrometer is a time-of-flight mass spectrometer.

27. The method of claim 22, wherein the particles are directed along the particle path using a particle accelerator that includes a multiple-stage vacuum system, each stage of the vacuum system including a vacuum pump and each stage directing individual particles along the particle path.

28. The method of claim 27, wherein the multiple-stage vacuum system includes a plurality of concentric tubes supporting a vacuum of progressively increasing amount; and wherein the plurality of concentric tubes are separated from each other by skimmers aligned along the particle path.

29. The method of claim 22, wherein the beam of desorbing light includes light from an Nd:YAG laser that produces pulses of light having sufficient energy to desorb the particles.

30. The method of claim 22, wherein aerodynamic sizes of the particles traveling along the particle path are determined prior to the determination that they have arrived at the location for analysis.

31. The method of claim 22, further comprising detecting fluorescence emitted from the particle.

* * * * *